United States Patent [19]

Marta et al.

[11] 4,075,950

[45] Feb. 28, 1978

[54] RAILWAY LOCOMOTIVE TRUCK WITH RESILIENT SUSPENSION

[75] Inventors: Henry A. Marta, LaGrange Park; Kenneth D. Mels, Orland Park; Vijay K. Garg, Darien; Albert J. Miller, LaGrange Park, all of Ill.

[73] Assignee: General Motors Corporation, Detroit, Mich.

[21] Appl. No.: 681,712

[22] Filed: Apr. 29, 1976

[51] Int. Cl.[2] ..... B61C 9/50; B61F 3/04; B61F 5/08; B61F 5/30

[52] U.S. Cl. ..... 105/197 A; 105/136; 105/182 R; 105/199 R

[58] Field of Search ..... 105/133, 135, 136, 196, 105/197 A, 172, 182 R, 199 R

[56] References Cited

U.S. PATENT DOCUMENTS

| | | | |
|---|---|---|---|
| 2,741,996 | 4/1956 | Kolesa | 105/196 |
| 2,954,747 | 10/1960 | Hirst et al. | 105/196 |
| 3,181,479 | 5/1965 | Rumsey et al. | 105/136 |
| 3,313,244 | 4/1967 | Koci | 105/172 |
| 3,387,569 | 6/1968 | Lich | 105/196 |
| 3,547,046 | 12/1970 | Lich | 105/182 R |
| 3,693,553 | 9/1972 | Lich | 105/136 |
| 3,712,246 | 1/1973 | Lich | 105/197 A X |
| 3,713,397 | 1/1973 | Parker et al. | 105/136 |
| 3,796,166 | 3/1974 | Wilmot | 105/199 R |
| 3,799,066 | 3/1974 | Jackson | 105/136 X |
| 3,937,153 | 2/1976 | Durocher | 105/197 A X |

*Primary Examiner*—Robert J. Spar
*Assistant Examiner*—Howard Beltran
*Attorney, Agent, or Firm*—Robert J. Outland

[57] ABSTRACT

A two-axle motor driven railway locomotive truck having a large low positioned center plate supported on a transverse bolster mounted low between the axles and carried on the truck frame by a four element focalized elastomeric secondary suspension which also transmits driving and braking forces. Elastomeric support pads are positioned low with effective compression load lines intersecting at rail height and forming obtuse included angles to substantially eliminate weight transfer effects and provide much higher stiffness in the longitudinal driving and vertical support directions than for lateral movements and fore-and-aft pitching motions between the frame and bolster. These effects combine with a soft primary spring suspension of the truck frame on the axle journals to provide low weight transfer for high adhesion performance and maintain good wheel load equalization when negotiating vertical rail irregularities, while eliminating wearing load carrying surfaces between the bolster and the truck frame.

3 Claims, 6 Drawing Figures

RAILWAY LOCOMOTIVE TRUCK WITH RESILIENT SUSPENSION

BACKGROUND OF THE INVENTION

This invention relates to railway locomotive trucks and more particularly to swivel type two-axle high adhesion trucks wherein a bolster-supported low-mounted center bearing is combined with an elastomeric pad bolster suspension arranged to absorb driving, braking and lateral forces, as well as vertical support loads, the suspension being focalized to minimize weight transfer by applying driving and braking forces effectively at rail level.

It is known in the prior art to provide a railway locomotive truck with a combination of a relatively soft primary suspension of the truck frame on the individual axle journals combined with a stiff secondary suspension of the bolster on the truck frame to obtain characteristics of relatively low weight transfer for high adhesion performance in trucks having three axles. It is further known to provide a railway truck with an elastomeric bolster suspension which is focalized to effectively transmit tractive forces to the locomotive body structure approximately at rail level and thus greatly reduce or eliminate weight transfer between the locomotive axles in operation.

SUMMARY OF THE INVENTION

The present invention combines some of the known principles of the prior art with new design concepts and features to provide in a two-axle locomotive truck good load equalization for vertical rail irregularities, elimination of wearing surfaces between the truck bolster and frame, and a high degree of freedom from weight transfer under load and braking conditions, whereby a superior high traction truck arrangement is provided.

The combination of features which provides these results includes the use of a relatively large center plate, supported at a low level within the truck frame on a transverse bolster centered between the truck axles and supported on a low positioned elastomeric focalized suspension that transmits driving and braking forces from the frame to the locomotive body effectively at the rail level. The elastomeric bolster suspension is positioned with the focalized pad normals having a high included angle of more than 90 degrees to provide a higher stiffness for longitudinal driving and braking forces than for vertical support forces and having a much lesser stiffness for lateral motions and fore-and-aft rocking motions (pitching) of the frame relative to the bolster. The additional feature of a soft primary spring suspension between the axle journals and the truck frame combines with the secondary suspension arrangement to provide the desired characteristics.

These and other features and advantages of the invention will be more fully understood from the following description of a preferred embodiment, taken together with the accompanying drawings.

DETAILED DESCRIPTION

Figure 1:
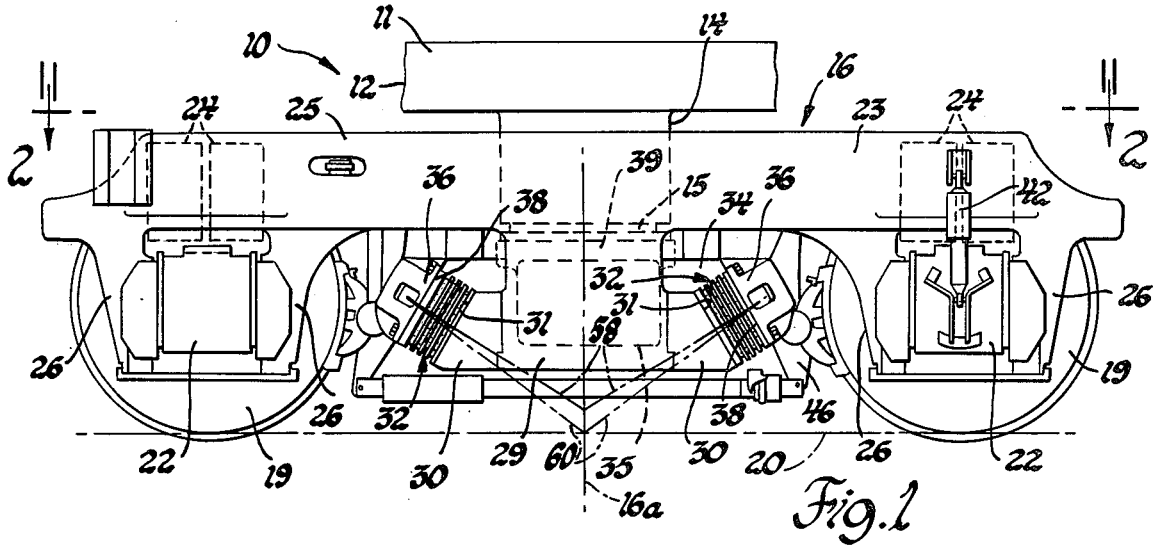
FIG. 1 is a side elevational view of a high traction railway locomotive truck supporting an associated carbody and having the features of the present invention.
Figure 2:
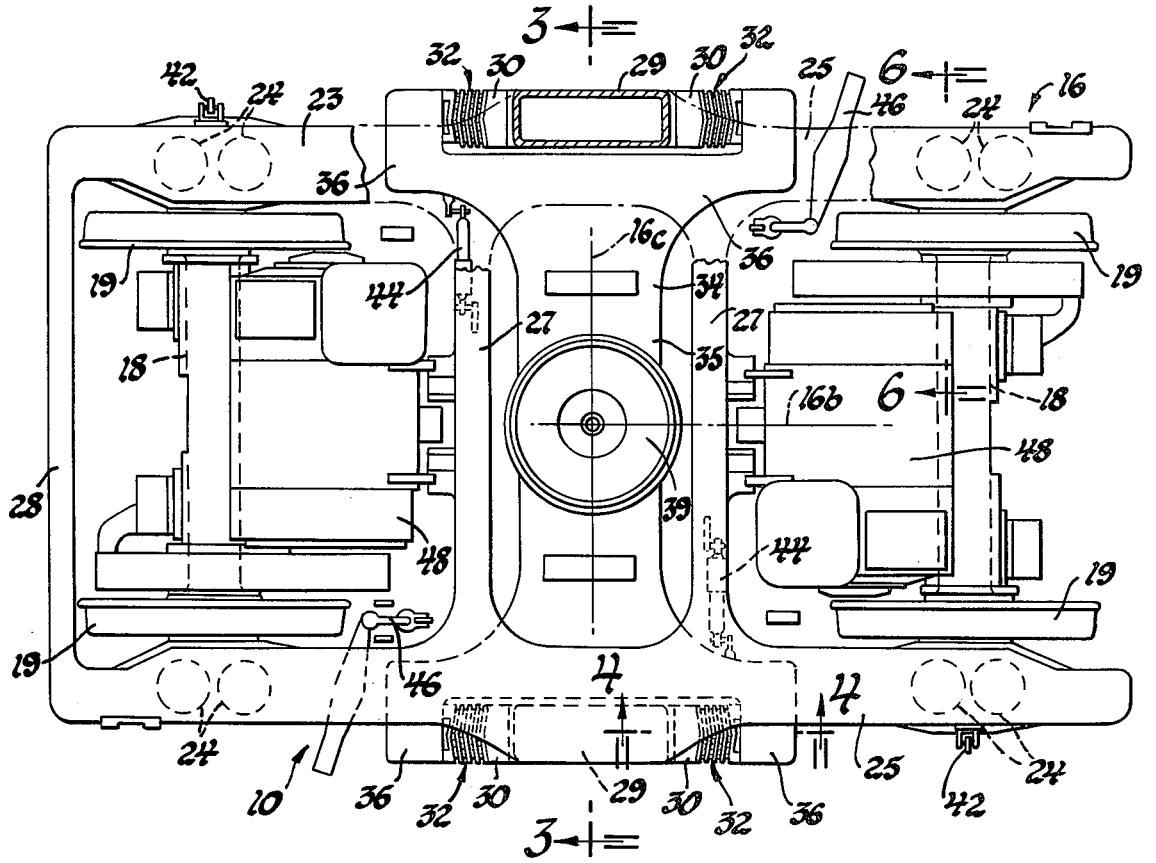
FIG. 2 is a top view of the truck as seen from the plane indicated by the line 2—2 of FIG. 1.
Figure 3:
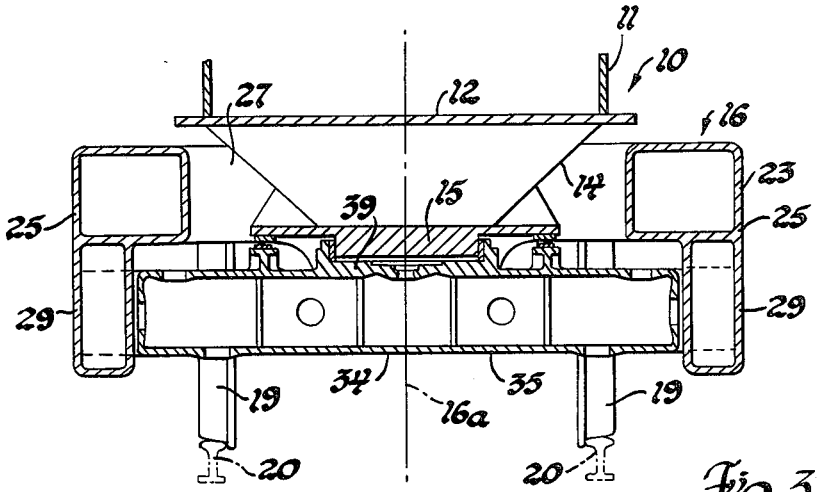
FIG. 3 is a transverse cross-sectional view of the truck and carbody assembly taken generally in the plane of the line 3—3 of FIG. 2.
Figure 4:
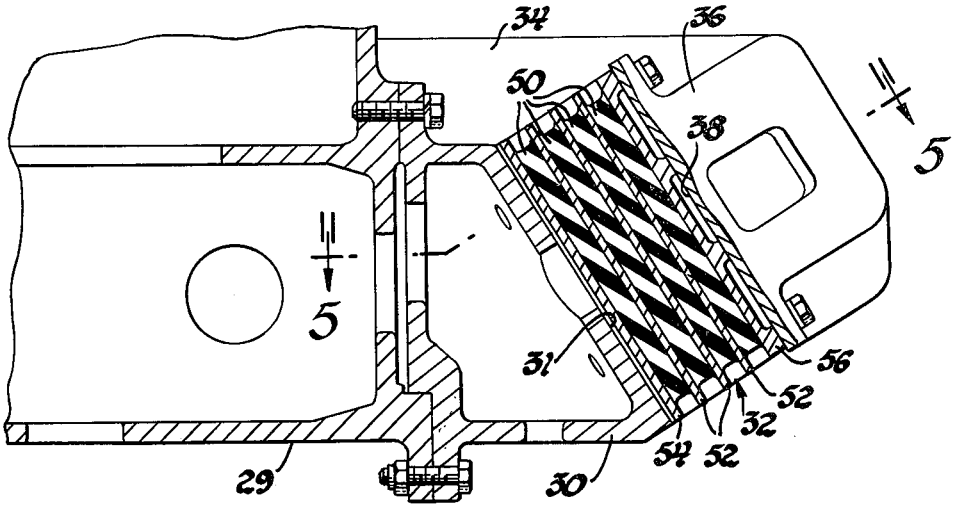
FIG. 4 is a fragmentary cross-sectional view through elements of the secondary bolster suspension system taken in the plane indicated by the line 4—4 of FIG. 2.

Referring now to the drawings with more particularity, there is shown a portion of a railway locomotive generally indicated by numeral 10 and including a carbody 11 having an underframe 12. Near each end, the locomotive underframe is provided with a downwardly projecting fixed bolster 14 which extends transversely of and supports the underframe. Laterally centered on the bottom of the bosster 14 at a distance substantially below the main portion of the locomotive underframe is a circular center plate 15 that provides a swivel connection by means of which the respective end of the locomotive carbody is secured to and supported by an associated swivel truck generally indicated by numeral 16 and having vertical, longitudinal and lateral axes **16*a*, 16*b* and 16*c*,** respectively.

The locomotive truck 16 has a pair of longitudinally spaced axles 18 mounting flanged wheels 19 for supporting and guiding the truck on the rails 20 of an associated track. Outboard of the wheels, the axles 18 carry journal boxes 22 on which a rigid truck frame 23 is supported by means of a relatively soft primary suspension comprising coil springs 24.

The truck frame as illustrated is a cast member, although it could equally well be formed as a welded fabrication or be constructed in any other suitable manner. The frame 23 includes a pair of generally straight side frame portions 25 extending longitudinally and forming the opposite sides of the truck. At their ends are provided depending pedestals 26 slidably receiving the respective journal boxes. The side frame portions 25 are formed primarily as simple box sections, but with some enlargement at their centers and with openings near their ends to provide for receiving the primary suspension springs 24. Portions 25 are laterally interconnected by a pair of transoms 27 longitudinally spaced on opposite sides of the lateral truck axis **16*c*. The ends may be left open or connected by end transoms 28**.

A pair of bolster supports 29 extend downwardly from the side frames, one on each side, and are centered on the lateral truck axis. The bolster supports each carry a pair of demountable pad support members 30, which are mounted at longitudinally opposite ends of the bolster supports and provide upwardly facing load surfaces 31 that are angled upwardly and inwardly toward their respective bolster supports. Demountably supported on each of the surfaces 31 is a sandwich type elastomeric support pad 32.

A bolster 34 is carried in the truck frame and includes a main body 35 extending laterally between the transoms 27 at about the height of the axles 18. On the ends of the main body are longitudinal arms 36, each of which extends adjacent the inner side of a respective bolster support 29 of the truck frame and outwardly around said support member to provide downwardly facing load surfaces 38 that engage and are supported by the support pads 32. A center plate 39 is provided on the top of the bolster main body 35 at a height well below the tops of the side frames and closer to the level of the axles. Center plate 39 is centered on the vertical axis 16*a* of the truck and engages the respective underframe mounted center plate 15 for pivotally guiding and supporting one end of the locomotive carbody on the truck 16.

The truck may be provided with damping means such as friction or hydraulic snubbing devices for damping lateral, vertical and rolling oscillations of the carbody. Such means may include snubbers 42 arranged vertically between the truck frame and associated journal boxes at diagonally opposite positions of the truck and snubbers 44 arranged laterally between the truck frame transoms 27 and the bolster 34 at diagonally opposite positions of the truck. The truck is also conventionally provided with brake rigging generally indicated by numeral 46 and may be powered by traction motors 48 conventionally supported between the axles 18 and the transoms 27 of the truck frame.

Figure 5:
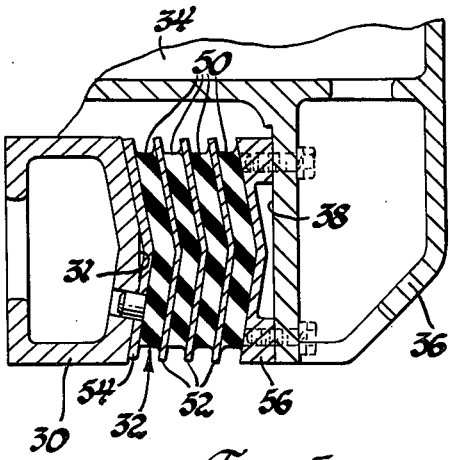
FIG. 5 is a cross-sectional view showing further details of the secondary suspension elements and taken in the plane generally indicated by the line 5—5 of FIG. 4.
Figure 6:
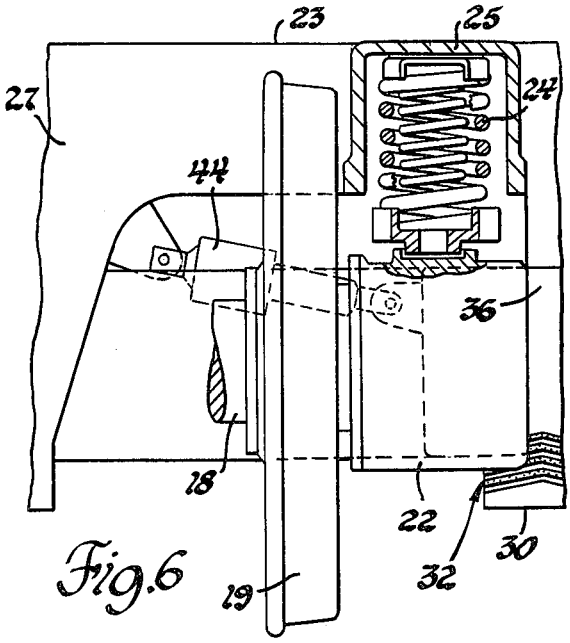
FIG. 6 is a fragmentary cross-sectional view showing the elements of the primary frame suspension and the bolster lateral snubbing means and taken in the plane of the line 6—6 of FIG. 2.

Referring to the secondary suspension by which the bolster is supported on the truck frame, it is noted that the four support elements, or pads, 32 are formed by slabs 50 of rubber or other elastomeric material separated by metal plates 52 and stacked sandwich fashion between end members 54, 56 that are secured between the opposing surfaces 31, 38 of the bolster supports and bolster, respectively. The rubber pad members comprise suspension elements that are very stiff in compression that is in a direction perpendicular to the loaded surface of the rubber, while being much more flexible or resilient in shear; that is, in a direction parallel to the loaded surface of the rubber elements. In the present instance, each pad, as shown in FIG. 5, is formed with the rubber elements in a slightly V'd or chevron shape which has the effect of combining the shear forces with a degree of compression forces for lateral motion of pad elements.

The suspension is particularly designated so that a desired combination of characteristics is provided which results in low effective weight transfer between axles under traction and braking conditions, while still permitting a smooth stable ride for the locomotive carbody. To this end, the support pads 32 are positioned in the truck frame at a relatively low level which is below the already lower than normal center plate and is about or somewhat below the height of the axles.

The opposed surfaces 31, 38 between which the pads are retained are parallel and are formed at relatively steep angles such that the normals 58 through the centers of these surfaces and the associated pads intersect at points which are normally slightly above rail level. At their point of intersection the normals for the pads on each side of the truck form obtuse included angles; that is, angles of greater than 90°, and, in the illustrated arrangement, the angles formed are on the order of 116 degrees. These angular relationships provide a suspension stiffness ratio in the various directions such that if the vertical load stiffness is considered to be 1.0, the longitudinal stiffness for driving and braking approximates 1.9, while the lateral stiffness for absorbing side shock loads is approximately 0.13. These compare to a stiffness of the rubber material in pure shear of 0.07. Thus, it can be seen that the secondary suspension provides a very stiff load carrying element for driving and braking loads transmitted between the truck frame and bolster. A slightly softer suspension is provided for supporting the weight of the vehicle on the truck frame. However, the same load carrying elements provide a relatively much softer suspension for absorbing lateral thrust loads applied between the truck frame and bolster.

The desirable direction of load transmission for traction and braking forces applied to the locomotive carbody through the truck frame and bolster is such that these loads are effectively applied at the surface of the rail. To the extent this is accomplished, the effect of weight transfer between axles caused by traction and braking forces is substantially eliminated. The desired result is substantially accomplished in the present design by intersection of the normals to the pad and associated support surfaces slightly above the nominal rail position. This is done because in loading the suspension with the weight of the locomotive, the deflection of the pads changes the effective direction of the load paths through the pads such that the primary load carrying axes, or effective load lines 60, lie below the normals 58. The suspension is thus arranged so that the effective load lines 60 intersect at the rail surface under normal conditions. Obviously, to compensate for allowable wheel wear over the running life of a truck wheel set, it is necessary to approximate the normal conditions by designing the truck to have an effective load point above the rail in the new condition. This load point is then lowered as the wheels wear to a point where it is slightly below the rail when the wheels are worn to their replacement condition.

The relatively soft primary suspension system provided by the springs 24 on which the truck frame is supported on the axle journal boxes 22 provides for a relatively soft, though controlled, ride of the locomotive carbody in spite of the relatively hard secondary suspension of the bolster on the truck frame. The soft primary suspension also provides better wheel load equalization in regard to vertical rail irregularities than would be provided by an arrangement having a stiff primary suspension. In addition, the arrangement of the pads in the secondary suspension is such that longitudinal rocking or pitching motion of the truck frame with respect to the bolster is resisted primarily by shear force in the support pads and thus provides good inter-axle equalization characteristics of the truck.

The low weight transfer characteristics of the truck which result in improved adhesion performance are effective only to the point that the horizontal traction and braking loads applied between the bolster and carbody are not high enough to cause tipping of the bolster with respect to the locomotive underframe. Such tipping is substantially eliminated for all normal operating conditions of the locomotive by the low placement of the center plate within the truck frame which, it will be noted, is at a point below the main side frames of the truck and not far above the axles. This low positioning of the center plate combined with the use of a relatively large center plate diameter completely avoids the need for stops, other than safety stops, to be provided to prevent tipping of the bolster within the truck frame. Because of this design, all the support, traction, braking and lateral shock loads are carried by the rubber pad suspension under normal operating conditions. This eliminates the need for friction wearing surfaces to carry driving or braking loads between the bolster and truck frame as are provided in most other truck designs. Thus, not only does the arrangement provide added stability and freedom from substantial weight transfer, but reduces the need for replacement of wearing components.

While the invention has been described by reference to a specific preferred embodiment, it should be understood that numerous changes could be made in the features and arrangements of the truck design without departing from the spirit and scope of the inventive concepts disclosed. Accordingly, it is intended that the invention not be limited by the disclosed arrangement but have the full scope permitted by the language of the following claims.

What is claimed is:

1. A railway vehicle power truck having longitudinal and lateral central axes and comprising a pair of wheeled axles spaced apart longitudinally equidistant from said lateral axis, a rigid frame including (1) a pair of side frames extending longitudinally along opposite sides of the truck interconnecting and resiliently supported on said axles, (2) means laterally interconnecting said side frames, and (3) a bolster support depending from each of said side frames and centered between said axles, said bolster supports each having a pair of longitudinally spaced support points on their respective sides of said truck and equally spaced from said longitudinal and lateral central axes, a bolster extending laterally across said truck along said lateral central axis at about the height of said axles with a center bearing carried on the top of said bolster at a height substantially below the top of said side frames, said bolster having longitudinal arms extending laterally adjacent to said bolster supports with load points opposing the bolster support points of said frame, resilient suspension members disposed near axle height between said frame-carried bolster support points and said bolster carried load points and supporting said bolster on said frame, said suspension members on each side of said truck having primary load carrying axes angled downwardly and longitudinally inwardly to meet at points near rail height and in a vertical plane through the lateral central axis of the truck, said suspension members having high load carrying capacity and spring rates along their primary load axes and substantially lower capacities and spring rates in planes perpendicular thereto, said suspension members comprising the sole means to carry under normal operating conditions all combinations of vertical, longitudinal and lateral loads between said truck frame and bolster with a minimum of weight transfer between axles during the application of traction and braking forces, the low center bearing location limiting longitudinal bolster tipping forces.

2. A railway vehicle power truck having longitudinal and lateral central axes and comprising a pair of wheeled power axles spaced apart longitudinally equidistant from said lateral axis, a rigid frame including (1) a pair of generally straight side frames extending longitudinally along opposite sides of the truck above said axles and resiliently supported on and interconnecting the ends thereof, (2) a pair of spaced transoms laterally connecting said side frames adjacent but spaced oppositely from said lateral axis, and (3) a pair of bolster supports depending, one from each of said side frames and centered on said lateral axis, said bolster supports each having a pair of longitudinally spaced upwardly facing support surfaces disposed beneath said side frames and angled upwardly and inwardly toward their respective bolster supports, normals to the support surfaces of each bolster support intersecting slightly above rail level in the vertical plane through said lateral axis and forming obtuse included angles, a bolster carried in said frame and having a main member extending laterally between said transoms at about the height of said axles and carrying on its top a center plate at a height closer to the lever of said axles than the height of the tops of said side frames, longitudinal arms on the ends of said bolster main member, each extending laterally adjacent one of said bolster supports and having on its ends a pair of downwardly facing load surfaces lower than said center plate and opposed and parallel to the upwardly facing surfaces of said bolster supports, elastomeric support pads mounted between the opposing surfaces of said bolster and bolster support elements and supporting said bolster in said frame, said pads being centered on and having compression axes substantially coincident with said normals to the bolster support surfaces, said pads comprising the sole means for transmitting under normal operating conditions all combinations of vertical, longitudinal and lateral loads between said frame and said bolster, the combination of low positioned center plate and support pads and angling of the compression axes of the pads longitudinally to meet slightly above rail level in the vertical plane through the lateral axis of said truck providing a truck arrangement with a minimum of weight transfer between axles under traction and barking conditions.

3. The combination of claim 2 wherein said normals to the support surfaces of each bolster support form included angles of approximately 116°, whereby an optimum relationship of vertical, longitudinal, and lateral suspension stiffnesses is provided.

* * * * *

UNITED STATES PATENT AND TRADEMARK OFFICE

CERTIFICATE OF CORRECTION

PATENT NO. : 4,075,950

DATED : February 28, 1978

INVENTOR(S) : Henry A. Marta et al

It is certified that error appears in the above-identified patent and that said Letters Patent are hereby corrected as shown below:

Column 6, line 27, "lever" should read --level--.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*